US005560265A

United States Patent [19]

Miller

[11] Patent Number: 5,560,265

[45] Date of Patent: Oct. 1, 1996

[54] ROCKER ARM MOUNTING STUD

[76] Inventor: James Miller, 1791 Blount Rd., Ste 501, Pompano Beach, Fla. 33069

[21] Appl. No.: 272,266

[22] Filed: Jul. 8, 1994

[51] Int. Cl.[6] ..... F01L 1/18

[52] U.S. Cl. ..... 74/559; 123/90.41; 123/90.42

[58] Field of Search ..... 74/559; 123/90.39, 123/90.41, 90.45, 90.42; 411/222

[56] References Cited

U.S. PATENT DOCUMENTS

| | | | |
|---|---|---|---|
| 2,503,469 | 4/1950 | Caldwell | 74/559 X |
| 3,589,346 | 6/1971 | Warren et al. | 123/90.41 |
| 3,621,823 | 11/1971 | Lombardi | 123/90.42 |
| 4,796,483 | 1/1989 | Patel et al. | 74/559 X |
| 5,323,741 | 6/1994 | Holzapfel et al. | 123/90.41 |

FOREIGN PATENT DOCUMENTS

| | | | |
|---|---|---|---|
| 0027360 | 4/1981 | European Pat. Off. | 411/222 |

OTHER PUBLICATIONS

Advertisement. Probe Industries, undated.

Advertisement, BLP Valve Train Parts, P07, undated.

*Primary Examiner*—Rodney H. Bonck

*Assistant Examiner*—Mary Ann Battista

*Attorney, Agent, or Firm*—McHale & Slavin, P.A.

[57] ABSTRACT

A rocker arm mounting stud assembly having a rocker arm mounting stud with adjustable rocker arm fixture mounting for use with a matching trunnion. Further provided is a radius roller tip rocker arm providing a third dimension principle by making the contact point of the diameter of the roller tip, a radius, lean on its pivoting access to control misalignment away from a two dimensional plane. A teaching of rocker arm geometry is provided for establishing precision measuring rules to facilitate the correct and precise installation of the rocker arm. Further provided is a one piece stud lock providing a direct pressure method of holding each rocker arm mounting stud with precise force providing overlapping components for retainment of each rocker arm mounting stud in a precision set predetermined position.

11 Claims, 4 Drawing Sheets

ROCKER ARM MOUNTING STUD

FIELD OF THE INVENTION

This invention relates generally to overhead valve engines, and more particularly, to an improvement in rocking arms and securement components used in overhead valve engines.

BACKGROUND INFORMATION

Internal combustion engines are used as the primary power plant for vehicles. An energy source such as gasoline or diesel fuel is used to cause expansion of fuel vapors or gases within cylinder chambers wherein pistons, connecting rods, and a crankshaft convert the pressure produced by the expansion into rotation movement. Control of the cylinder chamber is performed by sequential operation of intake and exhaust valves positioned into each chamber.

The valves are mechanically operated through a transfer of motion from a camshaft having eccentric oval shaped lobes. In overhead valve (OHV) engines, the camshaft lobes lift push rods which engage rocker arms mounted at the head of the cylinders. The rocker arms allow pivoting of the arm so as to rock up and down which in turn depress the biased intake and exhaust valve.

While this transfer of motion is effective, it does place a strain of the rocker arms and their related components during conditions of high torque such as when the engine is used for high performance applications including aircraft, automotive, marine, motorcycle and off-road use. During such use, even slight offset movement of rocker arm components may lead to incorrect tolerances multiplying efficiencies and causing burnt valves or possible cylinder destruction.

One such problem is the stud used for securing each rocker arm to the cylinder head. The typical rocker arm mounting stud is a steel threaded bolt used as the sole mounting device. A rocker arm can be secured to the stud with or without a means for adjusting operating clearances. A rocker arm design having adjustment ability will only control rocker arm loads from one direction while under load. However, when the rocker arm is in between operating cycles, and not underload, the rocker arm will "float" providing a lack of support to un-reciprocated component weight. A rocker arm design without adjustment is typically mounted in a fixed support position relying upon alternative methods of adjustment, such as the cam follower or hydraulic lifter, to provide a constant variable pre-load.

No device is known to combine the adjustability of floating rocker arms in combination with solid fixed mounts in the securement of the top and bottom of the rocker arm. The principle of the rocker arm retainment is to secure the rocker arm to the cylinder head limiting its upward motion at the pivoting point as retained by a single mounting stud that attaches to the cylinder head. Prior art single-stud designs are limited in attachment in a single direction, upward, away from the cylinder head and mounting stud and employ a single nut assembly atop the rocker arm for use as the locking device so as to securely attach the rocker arm to the mounting stud. This attachment allows the rocker arm to float when there is no upward load by the rotational action of the camshaft and its related components. There are two conventional design variations which affix the rocker arm to the cylinder head on a single stud mount design. The first design requires rocker arm adjustment. In such cases having a single rocker arm mounted to a single stud the design requires an adjustability of the rocker arm to provide for proper operating clearances to the related components thereby facilitating the adjustability of its installed height to the assembly of components. The second traditional design variation requires no rocker arm adjustment. In prior designs which have a single rocker arm mounted to a single stud for this operating method, the elimination of the need for adjustability for the rocker arm to provide for proper operating clearances rely upon a "bolt like" attachment to draw the rocker arm assembly down to a fixed and predetermined position whereby the required adjustability of the assembly of components is handled automatically by a hydraulic adjustment within a cam follower. This is also known as a lifter. In this type of design the rocker arm is pulled down upon a mounting stand that does not allow the rocker arms body to float as with the rocker arms that require providing a more permanently fixed attachment directly to the cylinder head. The hydraulic lifter does improve overall operation of the assembly but merely offers a decrease in assembly time by elimination of tolerance adjustment to the rocker arms. Thus, what is needed in the art is a rocker arm mounting stud which effectively combines adjustability with solid fixed blocking of the rocker arm to the cylinder head.

Still another problem with rocker arms is the pivoting action the rocker arm places on the mounting studs. Especially in high torque, high performance applications such as racing vehicles. In such application, demands are made that the rocker arm pivot point is maintained in a stable position. Misalignment of only a fraction of an inch can translate into incomplete operation of the intake or exhaust valve.

Attempts at increasing the rocker arm stability include the use of thicker castings which translates to heavier engines and heat dissipation problems. In single stud designs, a known device for stabilizing the upper end of the stud is a stud girdle. This device is secured by means of a horizontal clamping force placed around the stud mounting bolts by the use of straddling bars of metal, usually aluminum. The force is applied by simply coupling two or more adjusting nuts by use of a common bolt placed between them which would draw or tighten the two sides of the two piece girdle together. The result is a straddling of the adjusting nuts into a retained position by the use of clamping force.

The girdle is mounted on top of the rocker arm assembly, securely fastening to the rocker arm studs wherein deflection of one rocker arm stud is translated to the remaining rocker arm studs thereby strengthening and effectively eliminating any deflection. The problem with known stud girdles of the prior art is that by simply attaching a girdle to the rocker arm studs will not prevent stud deflection in all applications and may even lead to stud deflection if improperly installed. Further, it has been found that the use of stud girdles are ineffective in a number of high torque, high performance situations as the stud girdle typically comes in two piece sections that are required to be bolted together providing an area of expandability since the stud girdles use fasteners to hold the girdle together as well as incorporating the use of the studs to fasten the stud girdle to the cylinder head.

Thus what is needed in the art is a solid bar that applies a direct force between two or more studs in lieu of a girdle.

Another problem with rocker arms of the prior art is the metal on metal contact of a conventional non-roller rocker arm tip. Rocker arm designs without a roller tip are attached to the cylinder head in a number of ways to provide a reciprocal action to open the valves. Typically the roller tip rocker arm is mounted in a fashion so that its rotational motion is perpendicular to the linear path of the valve, providing a valve tip surface to have full contact across the width of the roller tip.

Numerous applications of American made overhead valve engines such as the 350 cubic inch "CHEVROLET" engine as well as the 302 and 351 cubic inch "FORD WINDSOR" engines have wedge combustion-chamber cylinder head designs wherein offset changes of the rocker arm between its mounting points to the head in the contact angle of the valve has introduced a misalignment of the normal rotational motion of the rocker arm. The misalignment has a significant increase in wear, thereby decreasing both longevity and performance. Prior known art to correct this situation has been to completely remachine the mounting angle of the rocker arm to the exact fraction of a third dimensional rotation. Alternatively, the rocker arm mounting system can be offset so as to keep the rocker arms access on a two plane rotational movement. Thus, what is needed in the art is a rocker arm providing a third dimensional rotation to compensate for misalignment.

SUMMARY OF THE INVENTION

The instant invention teaches an improved rocker arm assembly. One aspect of the invention is a rocker arm stud that provides both adjustability and fixed mounting of top and bottom when combined with a unique trunnion that is matched to provide the necessary contact surface of both sides. The combination provides a simple, single, locking mounting stud that secures the rocker arm from both above and below while also serving as an adjusting device for that retainment. The studs of the instant invention are used in combination with a double flat trunnion especially designed for coupling to the studs.

A stud lock bar of the instant assembly provides a direct pressure to mounting studs with a force provided by overlapping components, providing ultimate retainment of the rocker arms mounting studs in a rigidity similar to the base mount of the mounting studs.

A radius roller tip rocker arm of the instant invention provides a third dimension principle by making the contact point of the diameter of the roller tip, a radius, lean on its pivoting access to a controlled misalignment away from a limiting two dimensional plane. This provides a rotation of the rocker arms pivotal access without offsetting the contact points of the rocker. Further, the teaching of a roller tip rocker arm which can instruct the operator of its use and installation upon an engine to assure a minimum of wear to the components of the valve train.

Therefore, an objective of the instant invention is to improve the stability and accuracy of rocker arms and their interrelated components thereby increasing the performance and longevity rocker arm related assembly.

Still another objective of the instant invention is to provide for the adjustability of the rocker arm on a fixed single mounting stud and retainment of said adjustability so as to prevent loss of performance throughout the engines performance range. The adjustability of the rocker arm on single mounting stud designs is desirable in optimizing the variables of engine operation, the accuracy of this adjustment is directly related to the performance and longevity of components.

Yet another objective of the instant invention is to provide for a one piece stud lock to eliminate the need for stud girdles of the prior art.

Another objective of the instant invention is to provide a radius roller tip rocker arm providing a pivoting access to accommodate misalignment of rocker arms in relation to the intake and exhaust valve placement.

Yet another objective is to use the rocker arm body as an instrument for the installation geometry of the rocker arm upon the engine.

Still another objective is to teach an improvement to the roller arm which accepts the standards of: establishing that the least amount of radial motion occurs at a 90 degree angle to the axis of rotation; that installation of the roller rocker arm must be placed upon the valve to accommodate a "pivot point" which provides the axis to be 90 degrees to the angle of axis rotation; and correct assurance of this geometrical point of installation must symmetrically divide this 90 degree point to the amount of radial motion.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms a specific embodiment, it will be readily apparent to those skilled in this art that various modifications, rearrangements and substitutions can be made without departing from the spirit of the invention. The scope of the invention is defined by the claims appended hereto.

Figure 1:
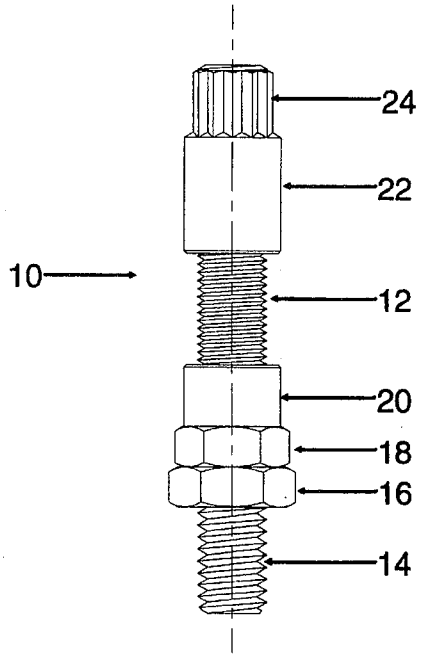
FIG. 1 is a side view of a single stud having an upper and lower adjusting nut.

Now referring to FIG. 1 shown is a rocker arm stud 10 of the instant invention consisting of a fully threaded mounting stud 12 having a lower portion 14 for threadingly engaging the cylinder head of a conventional overhead valve engine. Nut 16 is threaded onto the stud 12 locking engagement with lower adjusting nut 18. Tightening the locking nut 16 and adjusting nut 18 together provides a means for securing the enlarged threads 14 into the cylinder head to securely lock the stud 12 into the cylinder head. The lock nut 16 and lower adjusting nut 18 can then be loosened allowing the adjusting nut 18 to be positioned for placement of a rocker arm, not shown, by use of a rocker arm tolerance check device. The lower adjusting nut 18 includes sleeve 20 available for engaging a trunnion 25 which is the main axial component of a rocker arm which is used to hold the rocker arm in place allowing it to pivot upon bearings. With the lower adjusting nut 18 providing rocker arm body support from beneath the body, upper adjusting nut 22 is used to clamp the rocker arm between the two nuts 18 and 22. The upper adjusting nut utilizes a sleeve type shape allowing the nut to fit within the cradle of a conventional rocker arm wherein tightening is preferably performed by an aircraft type twelve point crown 24.

Figure 2:
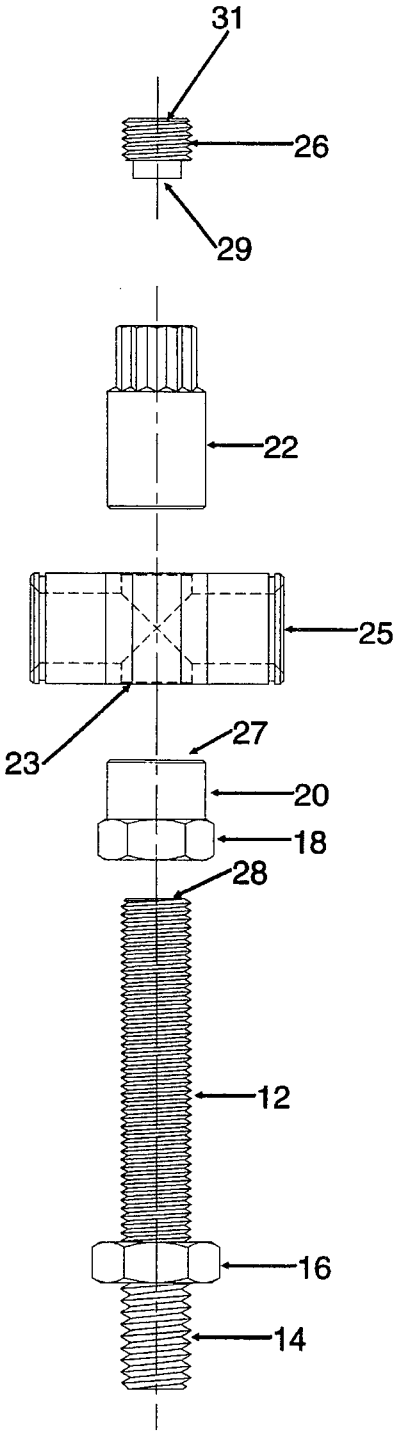
FIG. 2 is an exploded view of FIG. 1.

FIG. 2 sets forth an exploded view of FIG. 1 wherein optional locking screw 26 provides frictional engagement of threads located on the inner surface of the upper adjusting nut 22 so as to securely engage the upper portion 28 of the threaded mounting stud 12 upon engaging the lower surface 29 of the screw 26. Use of an allen wrench fitting socket 31 allows the screw 26 to be threaded within the interior chamber provided by the upper adjusting nut 22. Beginning with the upper portion 28 of the threaded mounting stud 12, shown is a fine thread placed along a substantial portion of the bolt 12. The lower portion 14 of the threaded mounting stud 12 employs the thread as typically found on a conventional cylinder head. Upon installation the adjusting nut 18 is set at a precise height wherein the sleeve, respective of the rocker arm design, allows adjustment of the upward movement of the lower adjusting nut 18 for securement by lock nut 14. The bottom surface 23 of the trunnion 25 engaging the upper surface 27 of the sleeve 20 providing a base for support of the trunnion allowing the rocker arm to pivotedly rotate around an axis of rotation provided by the trunnion. The trunnion holds the rocker arm body on engagement of the upper adjusting nut 22 wherein adjustment between the two nuts 22 and 18 now provide for a means of exact placement of the rocker arm body. The locking allen screw 26 can then be used to prevent any further movement of the upper adjusting nut while the lower nut 16 can be used to prevent any further movement of the lower adjusting nut 18.

Figure 3:
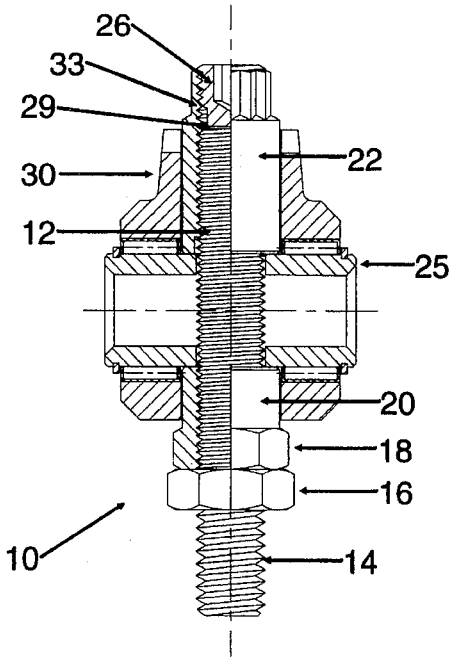
FIG. 3 is a partial cross Sectional front view of a single stud having an upper and lower adjusting nut coupled to a rocker arm.

Now referring to FIG. 3 shown is a partial cross-sectional side view of an assembled stud 10 with a rocker arm body 30 wherein the sleeve 18 and the body of the upper adjusting nut 22 fit within the confines of the rocker arm body 30 for engagement of the trunnion 25 allowing pivotal movement of the rocker arm in accordance with the push rod lifting and valve spring counter reaction. The trunnion 22 thereby holds the rocker arm body 30 in a vertical position as determined by the aforementioned adjusting nuts numerals 18 and 22. The sleeve 18 and upper adjusting nut 22 provides a vertical alignment for the rocker arm. The interior chamber 33 of the upper adjusting nut 22 is threaded further allowing insertion of allen screw 26 where the lower surface 29 frictionally engages the stud providing a secure lock.

Figure 4:
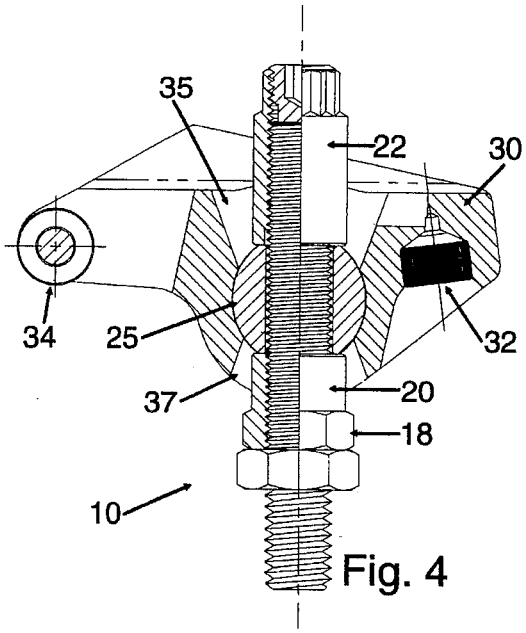
FIG. 4 is a partial cross sectional side view of FIG. 3.

FIG. 4 sets forth yet another view of the adjustable stud lock 10 wherein the rocker arm body 30 is clearly depicted with push rod support 32 located at one end of the rocker arm body and a roller tip 34 contact located at the opposite end of the rocker arm body. The engagement of the adjusting nuts 16 and 22 with the trunnion 25 illustrate the adjustability along the stud. Pivotal action of the rocker arm 30 is provided by cavity 35 for the upper nut 22 and cavity 37 for the sleeve 18 of the lower nut 16.

Figure 5:
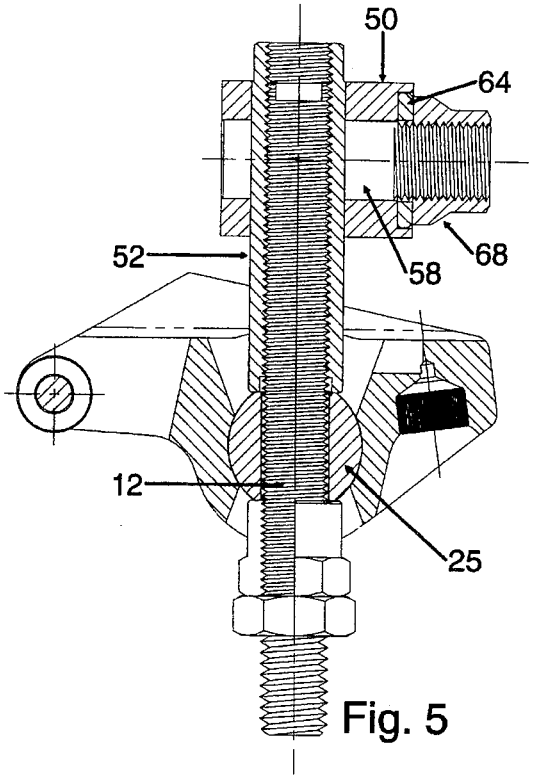
FIG. 5 is a partial cross sectional side view of a single stud having a lower adjusting nut and an elongated upper adjusting nut coupled to a rocker arm and support by a stud lock bar.

Now referring to FIG. 5 shown is a stud lock 50 of the instant invention which engages the stud bolt of the instant invention by use of a modified upper adjusting nut 52 for locking the trunnion 22 in a fixed position. On a typical engine, the stud lock is a 17 inch long piece of solid metal, such as aluminum, 1 inch high and 1.250 wide. The upper adjusting nut 52 includes an elongated length of 2.250 inches and similar to the normal adjusting nut 22 includes a 7/16 inch-20 threads per inch, female, with a 0.609 outer diameter sleeve having a 16–24 micron finish. Chambers for receipt of the sleeve of the adjuster nut are drilled, reamed, or bored to 0.611±0.002 inches and placed in accordance with the stud mounting location of the particular engine.

Figure 7:
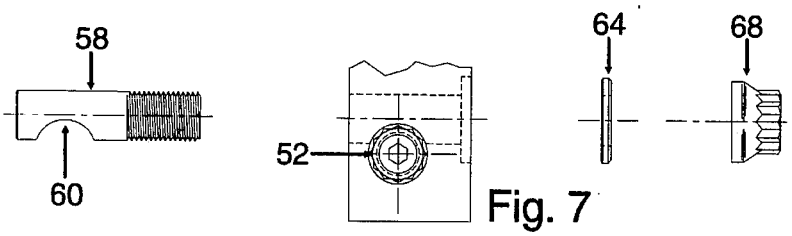
FIG. 7 is a top view of FIG. 6.
Figure 6:
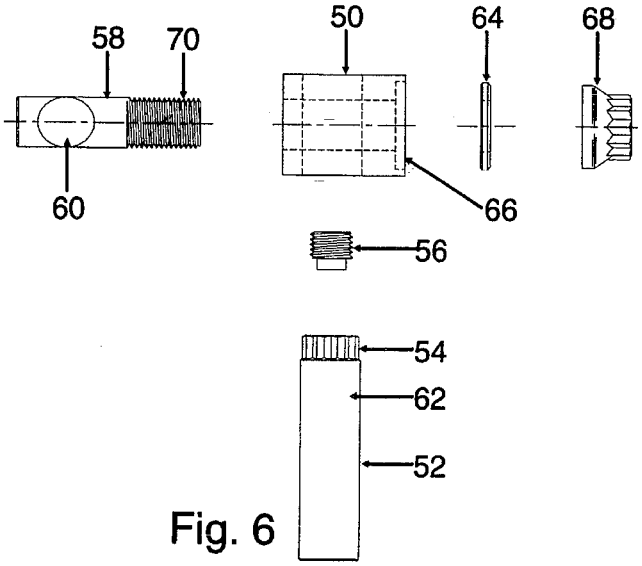
FIG. 6 is an exploded side view of stud lock assembly.
Figure 8:
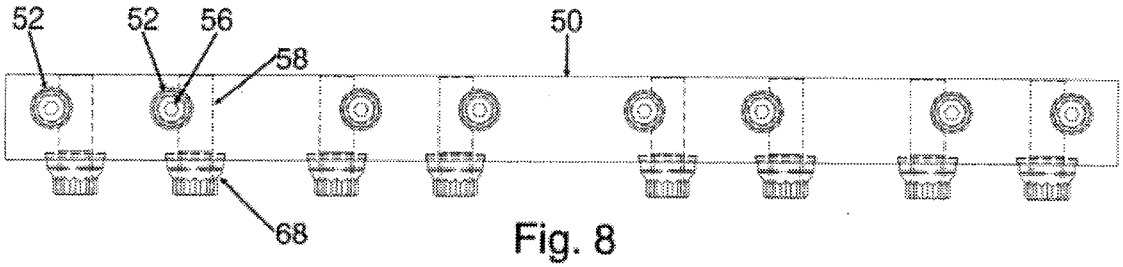
FIG. 8 is a top view of a stud lock bar with stud locks coupled to stud mounts.
Figure 9:
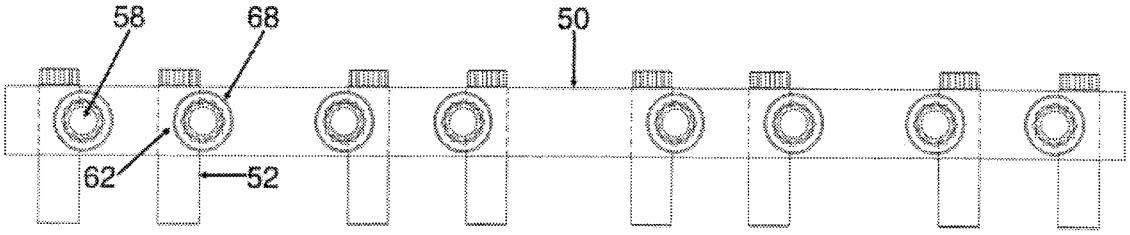
FIG. 9 is a side view of FIG. 8.

FIG. 6 is an end view of the stud lock 50 wherein the upper adjusting nut 52 preferably utilizes a 12 point crown 54 and an allen screw 56 in a similar manner as set forth above. In this particular embodiment a horizontally placed engagement bolt 58 is placed through the stud lock block 50 wherein a cutout 60 will engage the side surface 62 of the upper adjusting nut 52. The engagement bolt 58 is a lock stud having a 0.500 inch with 20 threads per inch. The lock stud is inserted in to 0.355 inch offset holes drilled 0.501±0.002 inches placed perpendicular to the center line of the adjuster holes. Upon insertion a lock washer 64 is fitted within a lock washer placement area 66 wherein lock nut 68, preferably a 12 point nut, 0.500 with 20 threads engages the threads 70 of the horizontally disposed bolt 58 thereby tightening of the lock nut 68 frictionally engages the cutout 60 formed from a 0.310 radius cut along the side surface 62 of the adjusting nut 52 securely fastening the components into a fixed position. The top view shown in FIG. 7 clearly sets forth the cutout 60 on the horizontally disposed bolt 58 and its offset location in regards to the upper adjusting bolt 52 for coupling to washer 64 and adjusting nut 68. FIG. 8 sets forth a top view of a stud lock 50 depicting the tops of each adjusting bolts 52 and the centrally disposed allen nut 56 with the offset horizontal attachment bolt 58 with lock nut 68 securely holding the components in a fixed position. In FIG. 8, the stud lock 50 is made from a solid piece of metal, such as aluminum or steel, with the aforementioned precision cut holes for engaging the side surface of each upper adjusting nut 52 coupled to the stud bolt of a conventional eight cylinder head. The locking block 50 is shown with its plurality of vertically disposed chambers, each said chamber sized approximately 0.002 inches larger than said sleeves of associated stud mounts. The block 50 is available for placement over stud mounts allowing at least a portion of said stud mounts to extent through the chambers. FIG. 9 sets forth yet another view of the stud lock 50 as viewed from the side so as to further illustrate the side surface 62 of each upper adjusting bolt and its relation to the horizontal securement bolts 58 which are set beneath the washer and adjusting nut 68.

Figure 10:
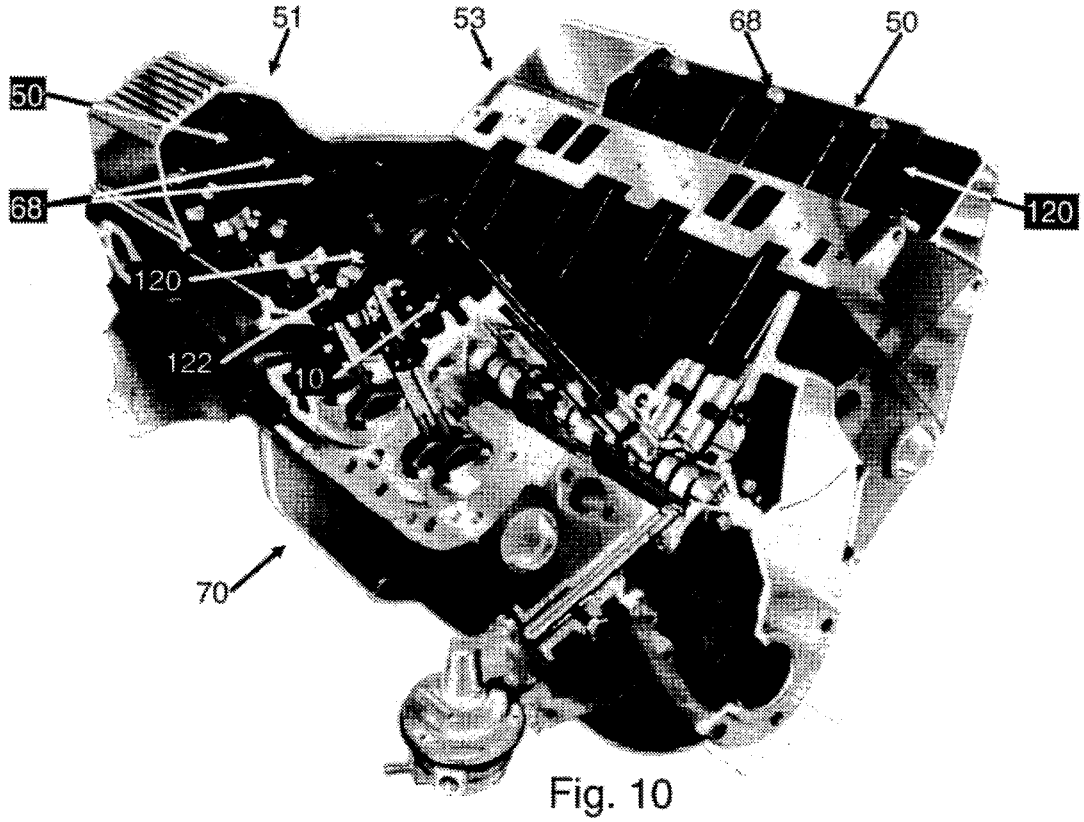
FIG. 10 is a pictorial view of a V-8 engine illustrating the assembly of the instant stud lock, stud adjustment bolts, and improved rocker arms.

Now referring to FIG. 10 the installation of the stud lock 50 is shown on the left bank 51 and the right bank 53 of a conventional eight cylinder overhead valve engine 70 wherein the stud bolts are shown protruding through the upper surface of the stud lock 50 where they can be easily tightened. Similarly the horizontal securement bolts 68 are shown in their offset location for engaging of the upper adjusting nut. As apparent by the illustration, the stud lock 50 provides a fixed placement between all of the rocker arm mounting studs 10 eliminating movement of any independent stud by reinforcement of an adjoining stud bolt. As further described during reference to FIGS. 13 and 14, the rocker arm 120 of the instant invention is shown with its bevel roller 122.

Figure 11:
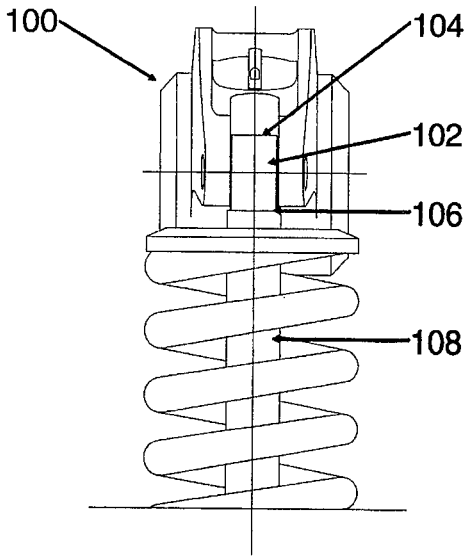
FIG. 11 is an end view of a conventional roller tip rocker arm having a flat roller.
Figure 12:
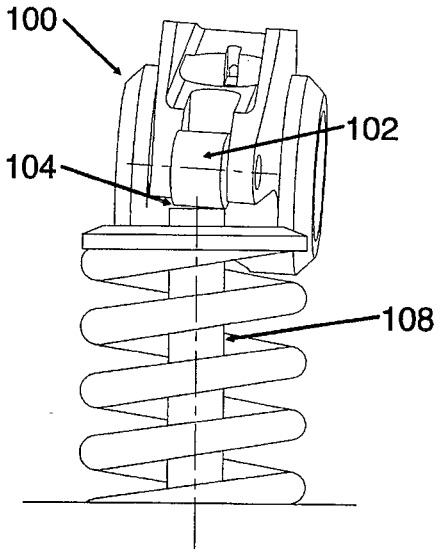
FIG. 12 is an end view of a conventional roller tip rocker arm having a flat roller in a misaligned state.

Referring to FIG. 11 shown is a conventional rocker arm 100 having a roller tip 102 which is a flat surface 104 providing broad surface contact with the tip 106 of an intake or exhaust valve stem 108. FIG. 12 sets forth the same rocker arm 100 wherein the roller tip 102 is shown in a slight misalignment causing the surface 104 of the roller tip 102 to engage only an edge of the intake or exhaust stem 108. In this particular instance the misalignment would cause the stem to be forced to one side which could cause premature wearing of the oil seal leading to oil burning in the engine.

Figure 13:
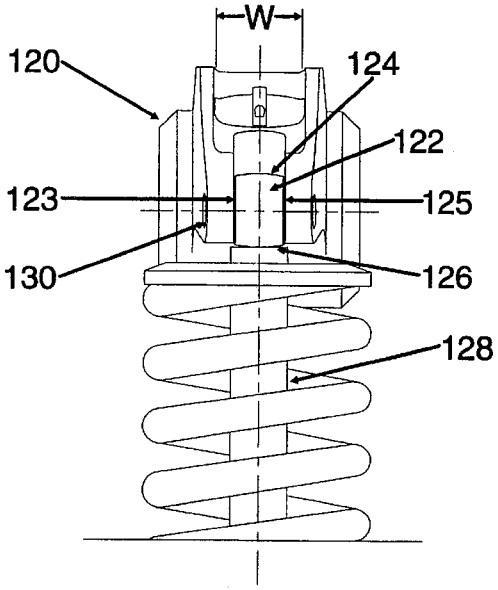
FIG. 13 is an end view of a roller tip rocker arm having a beveled roller of the instant invention.
Figure 14:
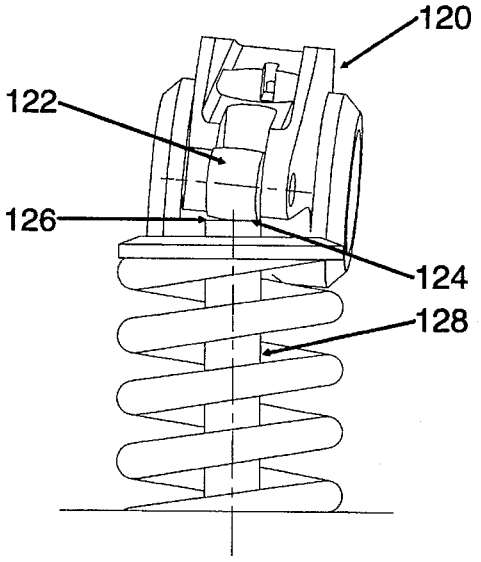
FIG. 14 is an end view of a roller tip rocker arm having a beveled roller of the instant invention in a misaligned state.

Now referring to FIG. 13 shown is the rocker arm 120 of the instant invention having a roller tip 122 with a curved surface 124 providing for a substantial contact over at least half of the roller tip with the end 126 of the intake or exhaust stem 128 during a normal and straight forward alignment setup. The improved roller tip comprises a roller 122 having an outer surface 124 and a width $W_1$ delineated by a first side 123 and a second side 125, the outer surface 124 has a larger diameter in the center or the surface 124 and a smaller diameter along each side 123 and 125 thereof. The roller 124 has a centrally disposed axis for insertion of a shaft 130 allowing rotation of the roller 124. Referring to FIG. 14 wherein a slight misalignment of the rocker arm 120 of the instant invention is shown wherein the roller tip 122 maintains at least one-half surface contact 124 on the tip 126 of the exhaust or intake stem 128. The curved roller tip 122 maintains sufficient surface area so as to provide controlled downward movement of the stem 128 without premature wear of the rocker arm, roller tip, or valve stem.

Figure 15:
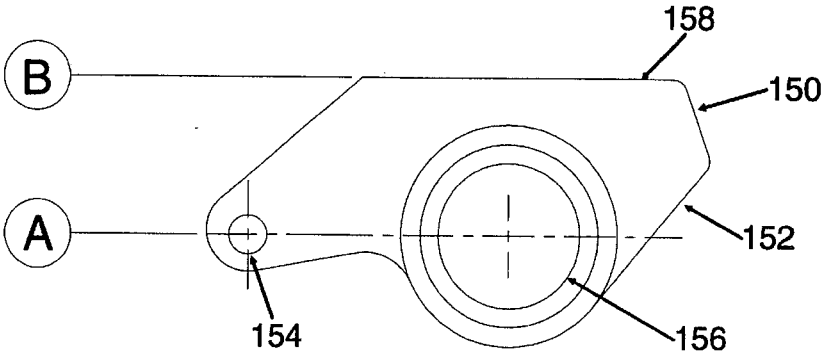
FIG. 15 is a side view of a roller tip rocker arm having a top portion of the rocker arm parallel to the roller tip datum line of motion.

FIG. 15 sets forth an improved rocker arm body 150 having a means for mounting to a stud bolt for receipt of a push rod 152 and a roller tip 154 on either side of pivotable bearing location 156. The improvement consists of machining the upper surface 158 of said rocker arm to a parallel plane "B" in accordance with a datum line of motion "A" of said roller tip 154. The datum line of motion "A" is set at 90 degree angle to a valve, not shown, at mid-lift point of motion. The improved roller arm sets forth a standard to establish that the least amount of radial motion occurs at a 90 degree angle to the axis of rotation; that installation of the roller rocker arm must be placed upon the valve to accommodate a "pivot point" which provides the axis to be 90 degrees to the angle of axis rotation; and correct assurance of this geometrical point of installation must symmetrically divide this 90 degree point to the amount of radial motion. The rocker arm provides precision measuring rules as part of the design of the rocker body to facilitate the correct, precise and easy installation of the rocker arm body.

It is to be understood that while I have illustrated and described certain forms of my invention, it is not to be limited to the specific forms or arrangement of parts herein describe and shown. It will be apparent to those skilled in the art that various changes may be made without departing from the scope of the invention and the invention is not to be considered limited to what is shown in the drawings and described in the specification.

What I claim is:

1. A rocker arm assembly apparatus comprising:

a threaded mounting stud having an upper portion defined by a first thread spacing and a lower portion defined by a second thread spacing, said lower portion available for engaging a conventional stud bolt hole in a conventional overhead valve cylinder head;

a rocker arm a lower locking nut threadingly engaging said mounting stud along said first thread spacing;

a lower adjusting nut juxtapositioned to said lower locking nut and threadingly engaging said first thread spacing, said lower locking nut and said lower adjusting nut available for vertical positioning of said rocker arm, said lower adjusting nut including a means for positioning said rocker arm in relation to said lower adjusting nut; and an upper adjusting nut threadingly engaging said mounting stud securing said rocker arm between said upper adjusting nut and said lower adjusting nut; wherein said rocker arm is juxtapositioned between said upper adjusting nut and said lower adjusting nut.

2. The apparatus according to claim 1 wherein said means for positioning is further defined as a sleeve formed integral to said lower adjusting nut and projecting upwardly therefrom for frictionally engaging a trunnion of said rocker arm.

3. The apparatus according to claim 1 wherein said upper adjusting nut includes an external means for locking said upper adjusting nut to said mounting stud.

4. The apparatus according to claim 3 wherein said external means for locking said upper adjusting nut to said mounting stud is further defined as an allen screw insertable into an open end of said upper adjusting nut for engaging interior threads of said upper adjusting nut for frictional engagement with said mounting stud.

5. The apparatus according to claim 1 wherein said upper adjusting nut is further defined as a sleeve having a predetermined length having a threaded interior chamber.

6. The apparatus according to claim 5 wherein said upper adjusting nut includes a 12 point crown for use in rotational securement.

7. The apparatus according to claim 5 including a stud lock wherein said sleeve of said upper adjusting nut is elongated for engagement of said stud lock.

8. The apparatus according to claim 7 wherein said stud lock is further defined as a single piece of rigid material having a plurality of vertical chambers available for insertion and engagement of a plurality of said upper adjusting nuts and a plurality of corresponding horizontally disposed chambers for receipt of coupling bolts.

9. A rocker arm assembly apparatus comprising:

a threaded mounting stud having an upper portion defined by a first thread spacing and a lower portion defined by a second thread spacing, said lower portion available for engaging a conventional stud bolt hole in a conventional overhead valve cylinder head;

a rocker arm a lower locking nut threadingly engaging said mounting stud along said first thread spacing;

a lower adjusting nut juxtapositioned to said lower locking nut and threadingly engaging said first thread spacing, said lower locking nut and said lower adjusting nut available for vertical positioning of said rocker arm;

an upper adjusting nut formed from an elongated sleeve threadingly engaging said mounting stud securing said rocker arm between said upper adjusting nut and said lower adjusting nut;

a stud lock formed from a single piece of rigid material having a plurality of vertical chambers sized for insertion and frictional engagement to said sleeve of a plurality of said upper adjusting nuts, said stud lock having a plurality of horizontally disposed chambers;

coupling bolts operatively associated with said plurality of horizontally disposed chambers adapted to rigidly secure each said upper adjusting nut to said stud lock;

wherein said rocker arm is juxtapositioned between said upper and said lower adjusting nuts, said stud lock adapted to couple to said upper portion of a pluratily of said mounting studs securing each said mounting stud in a stabilized position.

10. The apparatus according to claim 9 wherein said upper adjusting nut includes an external means for locking said upper adjusting nut to said mounting stud.

11. The apparatus according to claim 10 wherein said external means for locking said upper adjusting nut to said mounting stud is further defined as an allen screw insertable into an open end of said upper adjusting nut for engaging interior threads of said upper adjusting nut for frictional engagement with said mounting stud.

* * * * *